US006867660B2

(12) United States Patent
Kitamori et al.

(10) Patent No.: US 6,867,660 B2
(45) **Date of Patent: *Mar. 15, 2005**

(54) LINE TRANSITION DEVICE BETWEEN DIELECTRIC WAVEGUIDE AND WAVEGUIDE, AND OSCILLATOR, AND TRANSMITTER USING THE SAME

(75) Inventors: Nobumasa Kitamori, Nagaokakyo (JP); Kazutaka Higashi, Hirakata (JP); Toru Tanizaki, Nagaokakyo (JP); Hideaki Yamada, Ishikawa-gun (JP); Sadao Yamashita, Kyoto (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/107,569

(22) Filed: Mar. 26, 2002

(65) Prior Publication Data

US 2002/0101299 A1 Aug. 1, 2002

Related U.S. Application Data

(63) Continuation of application No. 09/472,473, filed on Dec. 27, 1999, now Pat. No. 6,489,855.

(30) Foreign Application Priority Data

Dec. 25, 1998 (JP) ..... 10-369932

(51) Int. Cl.[7] ..... H01P 1/16
(52) U.S. Cl. ..... 333/21 R; 333/239; 333/248
(58) Field of Search ..... 333/21 R, 239, 333/248

(56) References Cited

U.S. PATENT DOCUMENTS 4,559,490 A * 12/1985 Gannon et al. ..... 333/202
5,428,326 A * 6/1995 Mizan et al. ..... 333/219.1
5,600,289 A 2/1997 Ishikawa et al.
6,005,450 A 12/1999 Schmidt et al.
6,489,855 B1 * 12/2002 Kitamori et al. ..... 333/21 R

FOREIGN PATENT DOCUMENTS

| | | | |
|---|---|---|---|
| EP | 07-000112 A1 | | 3/1996 |
| JP | 355093307 | * | 7/1980 |
| JP | 61-57701 | | 4/1986 |
| JP | 2-199903 | | 8/1990 |

(List continued on next page.)

OTHER PUBLICATIONS

Korean Examination Report dated Dec. 19, 2001, along with an English translation.
Tsukasa Yoneyama, et al., "Insulated Nonradiative Dielectric Waveguide for Millimeter–Wave Integrated Circuits", IEEE Transactions on Microwave Theory and Techniques, vol. MTT–31, No. 12, Dec. 1983, pp. 1002–1008.
Youhei Ishikawa, et al., "Complex Permittivity Measurement of Dielectric Materials Using Nonradiative Dielectric Guide at Millimeter Wavelenth", Electronics & Communications in Japan, Part 2, vol. 79, No. 2, 1996., pp. 55–69.
J.A.G. Malherbe, et al., "A Transition From Rectangular to Nonradiating Dielectric Waveguide", IEEE Transactions on Microwave Theory and Techniques, vol. 33, No. 6, Jun. 1985, pp. 539–543.
Copy of Japanese Examination Report dated Sep. 24, 2003 (and English translation of same).

*Primary Examiner*—Benny Lee
*Assistant Examiner*—Kimberly Glenn
(74) *Attorney, Agent, or Firm*—Dickstein, Shapiro, Morin & Oshinsky, LLP.

(57) ABSTRACT

A line transition device which intervenes between a non radiative dielectric waveguide and a hollow waveguide for example, includes a dielectric waveguide having a dielectric strip held by a pair of conductors which face each other, and a waveguide, wherein a part of the dielectric strip of the dielectric waveguide is adjacent to or inserted in the hollow waveguide.

4 Claims, 16 Drawing Sheets

FOREIGN PATENT DOCUMENTS

| | | |
|---|---|---|
| JP | 8-256003 | 1/1996 |
| JP | 8-70205 | 3/1996 |
| JP | 8181502 | 7/1996 |
| JP | 8-288738 | 11/1996 |
| JP | 8316727 | 11/1996 |
| JP | 9-69705 | 3/1997 |
| JP | 11-308021 | 11/1999 |
| JP | 2000-22408 | 1/2000 |

* cited by examiner

LINE TRANSITION DEVICE BETWEEN DIELECTRIC WAVEGUIDE AND WAVEGUIDE, AND OSCILLATOR, AND TRANSMITTER USING THE SAME

This is a continuation of U.S. patent application Ser. No. 09/472,473, filed Dec. 27, 1999 now U.S. Pat. No. 6,489,855, in the name of Nobumasa KITAMORI, Kazutaka HIGASHI, Toru TANIZAKI, Hideaki YAMADA and Sadao YAMASHITA and entitled LINE TRANSITION DEVICE BETWEEN DIELECTRIC WAVEGUIDE AND WAVEGUIDE, AND OSCILLATOR, AND TRANSMITTER USING THE SAME.

BACKGROUND OF THE INVENTION

1. Field of the Invention

The present invention relates to high-frequency transmission-lines, and more particularly relates to a transmission-line having a line transition device between a dielectric waveguide and a waveguide. Moreover, the invention relates to a primary radiator, an oscillator, and a transmitter which use a line transition device.

2. Description of the Related Art

Dielectric waveguides and waveguides have been used as transmission lines for high frequencies, such as the microwave band, and the millimeter wave band. A typical example of a dielectric waveguide is a non-radiative dielectric (NRD) waveguide. A typical example of a waveguide is a hollow tube through which microwave electromagnetic radiation can be transmitted with relatively slight attenuation. Waveguides often have a rectangular cross section, but some have a circular cross section.

A line transition device between a dielectric waveguide and a waveguide is disclosed, for example, in Japanese Laid-open Patent Application No. 8-70205, which corresponds to U.S. Pat. No. 5,724,013, in which the line transition device between the dielectric waveguide and the waveguide is constructed by tapering an edge of a dielectric strip of the dielectric waveguide and expanding an edge of the waveguide into a horn-shape. The cross-sectional shape of the waveguide used for a line transition is normally rectangular. Line transition devices using a waveguide having a circular cross section are used infrequently.

However, the end face of the dielectric strip, and metal parts of the dielectric waveguide and of the waveguide must be shaped into a special form to realize the above-described tapered or horn-shapes. Thus, the transition becomes large. Moreover, such a line transition device is not suitable for changing the propagating direction of a signal because a bend at the transition causes lowering of the transmission efficiency.

In a multi-layered circuit, a structure which causes a dielectric waveguide in each layer to be electromagnetically coupled is disclosed, for example, in Japanese Laid-open Patent Application No. 8-181502. In the application, a through-hole passing through a layer is provided, and an edge of the dielectric waveguide is disposed in proximity to an end of the through-hole, whereby both dielectric waveguides are electromagnetically coupled through the through-hole.

This structure requires a reflector or the like to shield the through-hole, apart from a connection part between the through-hole and the dielectric waveguide, so that a signal propagating from the dielectric waveguide to the through-hole does not leak, which results in a higher cost.

One example of an antenna device using a dielectric waveguide is disclosed in Japanese Laid-open Patent Application No. 8-316727. A dielectric resonator is disposed in the proximity of an edge of the dielectric strip so as to be electromagnetically coupled with the dielectric strip. A high-frequency signal propagating through the dielectric strip is radiated from the dielectric resonator. The dielectric waveguide and the dielectric resonator are disposed between a pair of conductive plates facing each other. A slit is provided in the upper conductive plate adjacent to the dielectric resonator. An electromagnetic wave is radiated from the slit.

However, because the dielectric resonator is used as a primary radiator, it is difficult to expand a frequency band of the antenna.

SUMMARY OF THE INVENTION

According to the present invention, a transition device between a dielectric waveguide and a waveguide is constructed by placing a part of a dielectric strip of the dielectric waveguide adjacent to the waveguide, for example, generally perpendicular to the propagating direction of an electromagnetic wave in the waveguide. For even greater electromagnetic coupling, the part of the dielectric strip can advantageously be inserted into the waveguide.

This construction does not employ a construction with radiation from the end of the dielectric strip in the direction of the axis, which prevents unnecessary radiation, and which enables line transition converting to be performed with low loss. In addition, since the propagating direction of electromagnetic wave in the dielectric waveguide is perpendicular to that in the waveguide, the degree of freedom in designing a circuit construction is increased and miniaturization of the entire transition device can be achieved.

The above dielectric waveguide may be located between a pair of conductive plates facing each other. By unifying a part of the pair of conductive plates and an end of the waveguide, it is easy to obtain matching between the dielectric waveguide and the waveguide. Alternatively, in the transition device between the dielectric waveguide and the waveguide, by locally changing the shape of a cross section of the waveguide, it is easy to obtain matching between both the dielectric waveguide and the waveguide.

By placing multiple dielectric waveguides inserted into or adjacent to the waveguide, the dielectric waveguides are electromagnetically coupled through the waveguide. By appropriately selecting location positions, a transmission signal can be transmitted in an arbitrary direction. By appropriately selecting the length of the waveguide, in a multiple layer circuit, dielectric waveguides in different layers can be mutually electromagnetically coupled.

In the above transition device, by opening one end of the waveguide, the waveguide having the opening at the end thereof functions as a primary radiator. A signal is propagated through the dielectric waveguide and is radiated through the waveguide. Since the waveguide is used as a radiator, a broadband antenna device can be realized.

An oscillator of the present invention includes an oscillating element in the waveguide and a coupling conductor. The oscillating output signal is transmitted from the oscillating element and is electromagnetically coupled with the coupling conductor in a resonance mode of the waveguide. This construction allows the oscillating output signal to be converted into a signal in the transmission mode of the dielectric waveguide through the resonance mode of the waveguide. These constructions enable the oscillating signal to be easily transmitted through the dielectric waveguide.

A transmitter of the present invention includes the dielectric waveguide, an antenna device having the primary radiator employing the waveguide, and an oscillator generating a transmission signal to the antenna device. Alternatively, the transmitter includes the dielectric waveguide, the oscillator employing the waveguide, and the antenna device transmitting the output signal from the oscillator. With above these constructions, the transmitter having small size, low loss, and a broad band can be obtained.

Other features and advantages of the present invention will become apparent from the following description of embodiments of the invention which refers to the accompanying drawings.

DESCRIPTION OF EMBODIMENTS OF THE INVENTION

Figure 1:
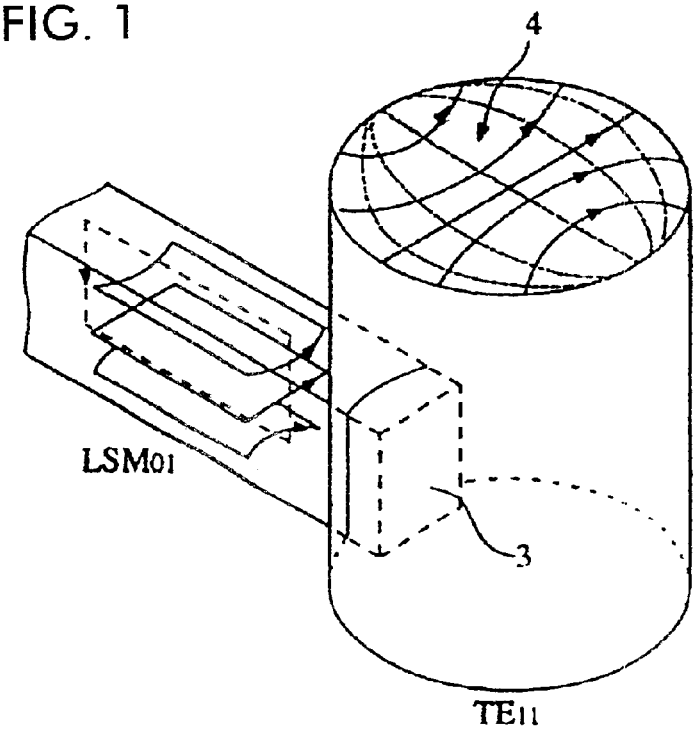
FIG. 1 shows a perspective view illustrating a construction of main components of a transition device between a dielectric-waveguide and a waveguide.

A construction of a transition device between a dielectric-waveguide and a waveguide according to a first embodiment of the present invention is described with reference to FIGS. 1 to 3. In FIGS. 2A to 2C, conductive plates 1 and 2 are provided so as to surround a dielectric strip 3. The conductive plates 1 and 2 and the dielectric strip 3 form an NRD guide. The conductive plate 1 has a columnar hole of which the inner diameter is $\phi a$ and the depth is L. The conductive plate 2 has a concave part of which the inner diameter is $\phi a$ and the depth is the same as the height of the dielectric strip 3. When the conductive plate 1 is stacked on the conductive plate 2, the columnar cavity waveguide 4 is formed by overlapping the hole of the conductive plate 1 with the concave part of the conductive plate 2. The cross section of the waveguide is not necessarily circular; it may be angular as required.

Figure 2A:
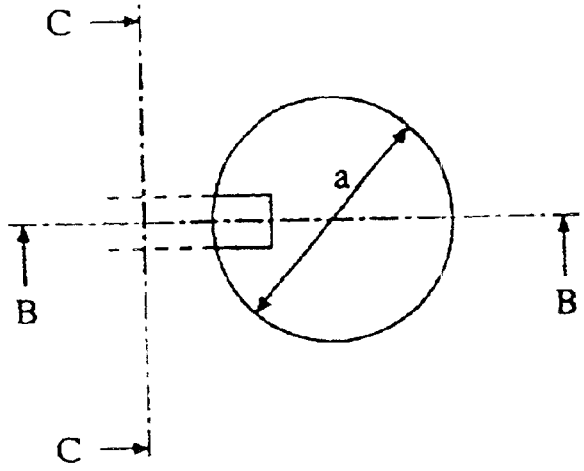
FIGS. 2A, 2B, and 2C show a plan view and cross-sectional views, respectively, showing a construction of the transition device between the dielectric-waveguide and the waveguide.
Figure 2B:
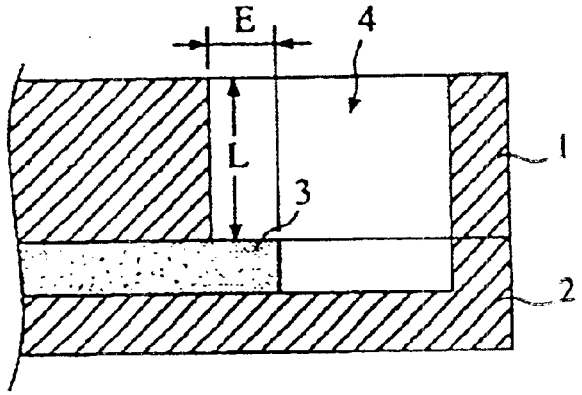
Figure 2C:
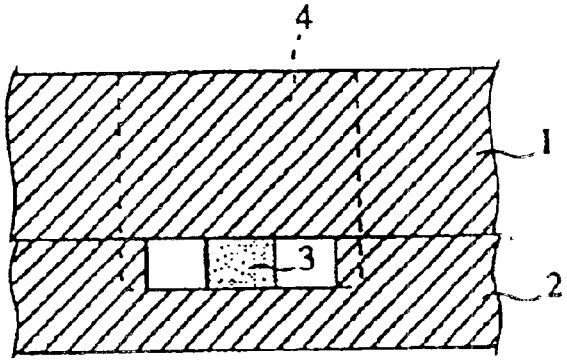

FIG. 1 shows an engaging relationship between the cavity waveguide 4 and the dielectric strip 3 of the NRD guide. The dielectric strip 3 is preferably disposed so that an edge thereof is inserted in the waveguide 4. However, the end of the dielectric strip may also be adjacent or coplanar to the circumference of the cavity waveguide 4 and not projecting into the waveguide.

The inner diameter $\phi a$ of the columnar cavity waveguide 4 is determined in accordance with a frequency band. For example in the 76 GHz band, the inner diameter $\phi a$ is 2.8 mm, the inserted length E of the dielectric strip 3 inside the waveguide 4 is 0.9 mm, and the length L between the top face of the dielectric strip 3 and the opening of the waveguide 4 is 1.0 mm (FIG. 2B). When the guide wavelength of the waveguide 4 is $\lambda_g$, it is desirable that $L=(\lambda_g/4)\cdot n$ where n is an integer which is equal to or more than 1. Accordingly the top face of the dielectric strip 3 which is located below a quarter of the wavelength from the opening of the waveguide 4 becomes a short-circuit plane, which makes it easy to have matching between the NRD guide and the waveguide 4.

The solid line arrows in FIG. 1 indicate an electric field distribution and the broken line arrows, perpendicular to the solid line arrows, indicate a magnetic field distribution. The basic transmission mode of the NRD guide is an $LSM_{01}$ mode where a magnetic field affects the upper and the lower conductive plates in the vertical direction thereof. The basic transmission mode of the columnar cavity waveguide 4 is a circular $TE_{11}$ mode. The electromagnetic field is distributed so that the direction of the magnetic field in the $LSM_{01}$ mode and that in the circular $TE_{11}$ mode are arranged in order, whereby line transition is realized by electromagnetic-coupling of the NRD guide in the $LSM_{01}$ mode and the columnar cavity waveguide 4 in the $TE_{11}$ mode. It is desirable that the direction of extension of the NRD guide and that of the waveguide 4 are generally perpendicular to each other. However, as long as adequate electromagnetic-coupling is established between the NRD guide and the waveguide 4, the extensions do not necessarily have to intersect at a right angle, so a deviation from a right angle is acceptable.

Figure 3:
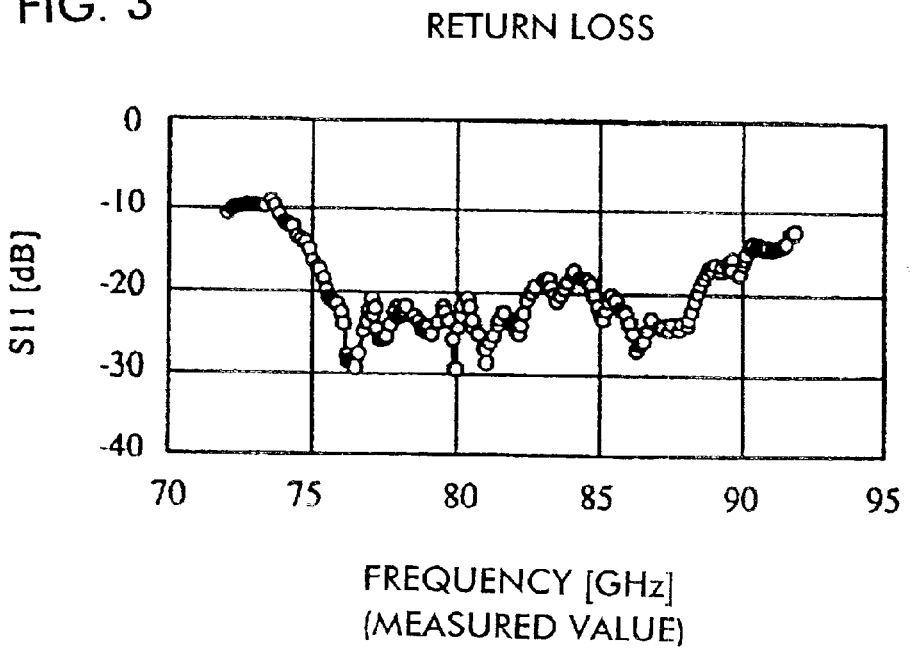
FIG. 3 shows characteristics of the transition device between the dielectric-waveguide and the waveguide.

FIG. 3 shows the reflection characteristics of the line transition device observed from the NRD guide side. In FIG. 3, at frequencies of 75 to 90 GHz, low loss between 5 dB and 0 dB is realized. A symbol "S11" in FIG. 3 indicates loss in which an output is at a point where a signal is input. Thus, the invention which includes in this embodiment slight insertion of the dielectric strip in the waveguide 4 allows line transition to be performed, whereby low reflection characteristics are realized.

Figure 4A:
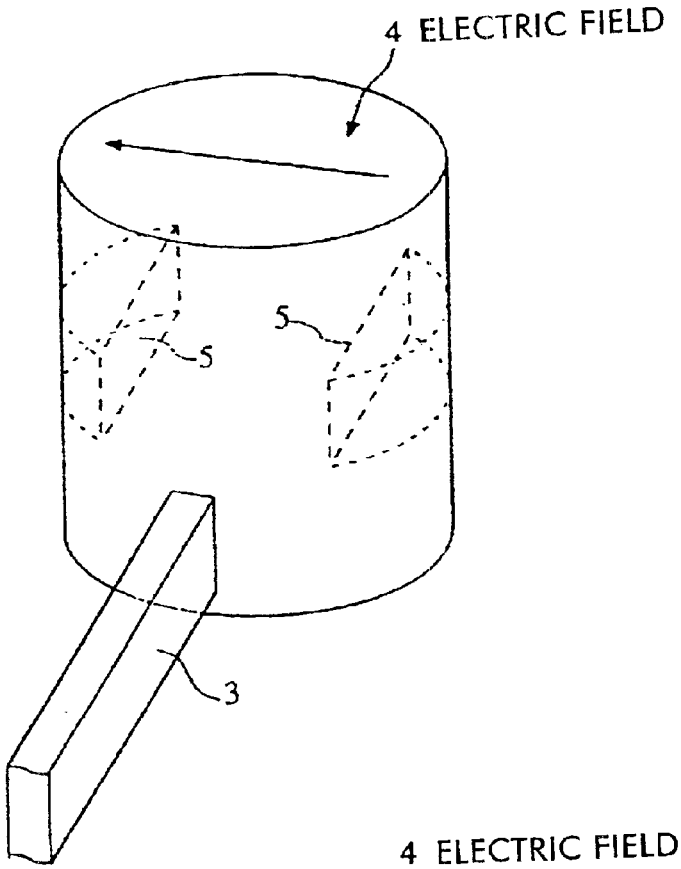
FIGS. 4A and 4B show a construction of a transition device having a matching adjusting device between a dielectric-waveguide and a waveguide.

Another example of a line transition device according to a second embodiment of the present invention is described with reference to FIGS. 4A, 4B, 5A, and 5B. In FIG. 4A, a pair of projections 5 is disposed on the inner wall of the waveguide 4 above the dielectric strip 3 of the NRD guide so that the inner diameter of the waveguide 4 is narrowed in the direction of the electric field in the circular $TE_{11}$ mode. The impedance of a region in which the pair of projections 5 face each other has an intermediate value between the impedance of the NRD guide and that of the waveguide 4. Accordingly, by setting the distance between the pair of the projections 5 to an appropriate value, matching between the impedance of the NRD guide and that of the waveguide 4 can be achieved.

Figure 4B:
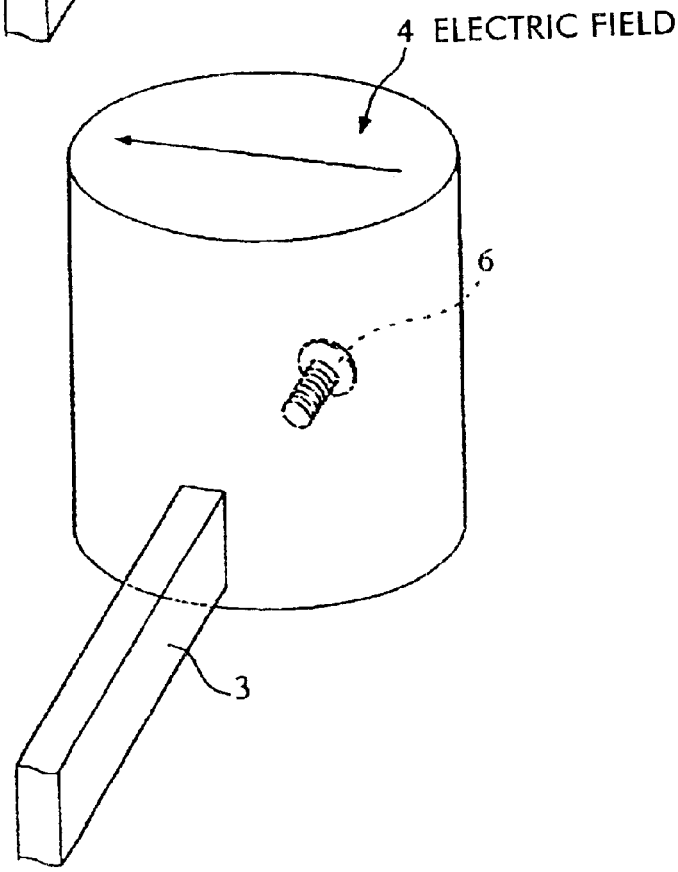

In FIG. 4B, instead of the pair of the projections 5, a screw 6 is disposed. By adjusting the insertion depth of the screw 6, the impedance of the waveguide 4 can be changed. As long as the internal impedance of the waveguide 4 can be adjusted from the outside, other types of members, besides the screw 6, may also be used.

Figure 5A:
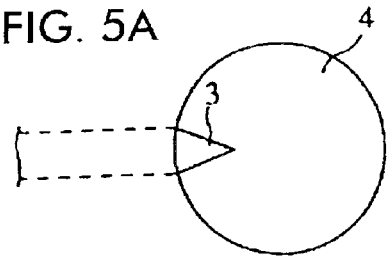
FIGS. 5A and 5B show a construction of the transition device between the dielectric-waveguide and the waveguide, which is matching-adjusted.
Figure 5B:
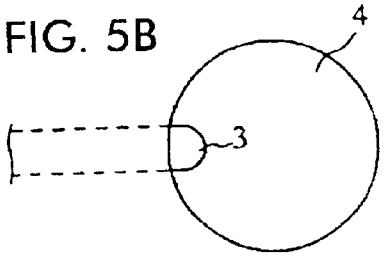

It is desirable that, throughout the present specification, the edge shape of the dielectric strip 3, which is inserted in the waveguide 4, may be changed in accordance with the intended use thereof. As shown in FIG. 5A, the edge shape of the dielectric strip 3 may be tapered. Alternatively, as shown in FIG. 5B, the edge shape may be rounded. In addition, the edge of the dielectric strip 3 can also be shaped to adjust matching with the waveguide 4.

Figure 6B:
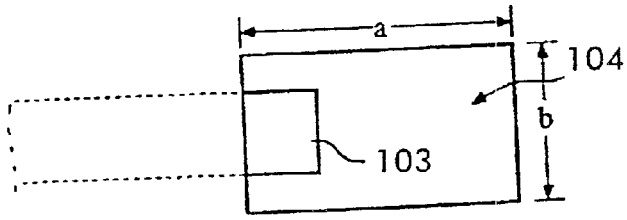
FIGS. 6A and 6B show a construction of main components of a transition device between a dielectric-waveguide and a waveguide, using a rectangular waveguide.
Figure 6A:
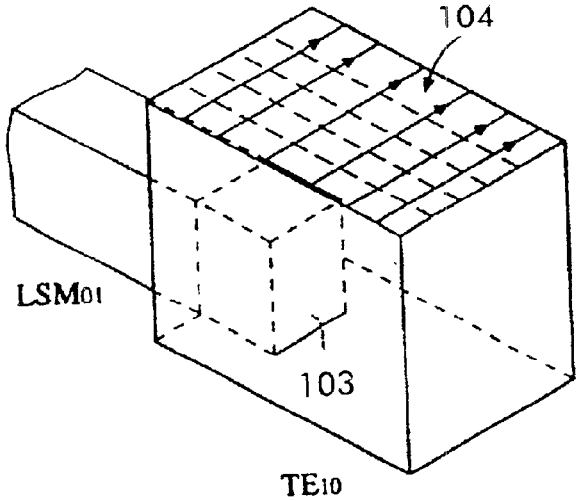

FIGS. 6A and 6B show a construction of a line transition device according to a third embodiment. In this embodiment, a rectangular cavity waveguide 104 is used instead of the columnar cavity waveguide 4 in the previous embodiments. It is desirable that the propagating direction of the electromagnetic wave through the waveguide 104 is perpendicular to that of the electromagnetic wave through the NRD guide. Dimensions a and b of the waveguide 104 are appropriately determined in accordance with the operating frequency. A solid line arrow indicates the electric field distribution and a broken line arrow, perpendicular to the solid line arrow, indicates the magnetic field distribution. The basic transmission mode of the NRD guide is an $LSM_{01}$ mode, the same as in FIG. 1. The basic transmission mode of the rectangular waveguide 104 is a rectangular $TE_{10}$ mode. Because the direction of the magnetic field in the $TE_{10}$ mode corresponds to that of the extension of a dielectric strip 103 in the magnetic field in the $LSM_{01}$ mode, the dielectric strip 103 and the waveguide 104 are electromagnetically coupled.

By appropriately selecting the length the dielectric strip 103 is inserted inside the waveguide 104 and the length between the top face of the dielectric strip 103 and the opening of the waveguide 104, matching between the NRD guide and the waveguide 104 is achieved. A matching adjusting device may be provided for the line transition device.

As in the previous embodiments, adequate coupling may be obtainable if the end of the dielectric strip 103 is adjacent or coplanar with the side wall of the rectangular waveguide 104.

A construction of a connecting part of the dielectric waveguide according to a fourth embodiment of the present invention is described with reference to FIGS. 7 and 8.

Figure 7:
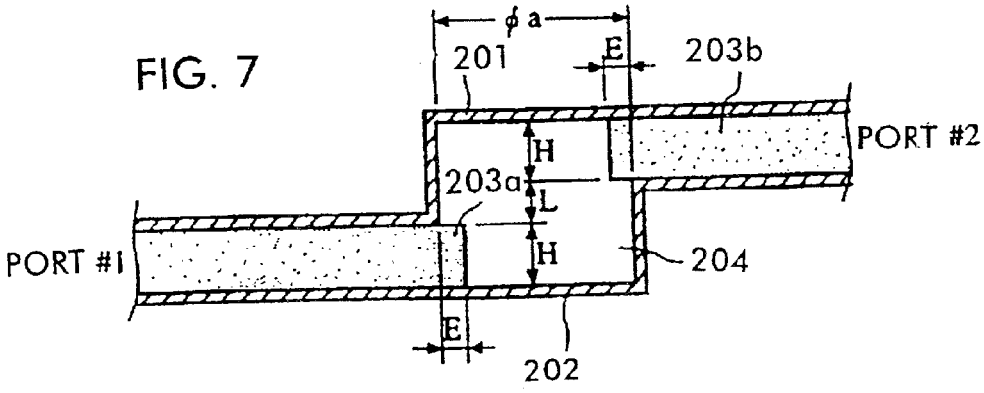
FIG. 7 is a cross-sectional view showing a construction of a connection part between a dielectric-waveguide and a waveguide.

As shown in FIG. 7, dielectric strips 203*a* and 203*b* are individually held between conductive plates 201 and 202, whereby the dielectric strip 203*a* and the upper and the lower conductive plates 201 and 202, respectively, constitute one NRD, and the dielectric strip 203*b*, and the upper and the lower conductive plates 201 and 202 constitute another NRD.

A waveguide 204 is provided between the above NRDs, and includes the upper and the lower conductive plates 201 and 202, respectively, and side walls (not shown). A predetermined end portion of each dielectric strip 203*a* and 203*b* is inserted into (or optionally may be adjacent to) the waveguide 204. It is desirable that the distance L between the top face of the dielectric strip 203*a* and the bottom face of the dielectric strip 203*b* is determined so that impedance matching is performed among the two NRDs and the waveguide 204. In this case, the top face of the dielectric strip 203*a* and the bottom face of the dielectric strip 203*b* are assumed to have an electrical ground potential.

The line transition device of the present embodiment can be applied to a high-frequency circuit having a double-layer structure.

Figure 9:
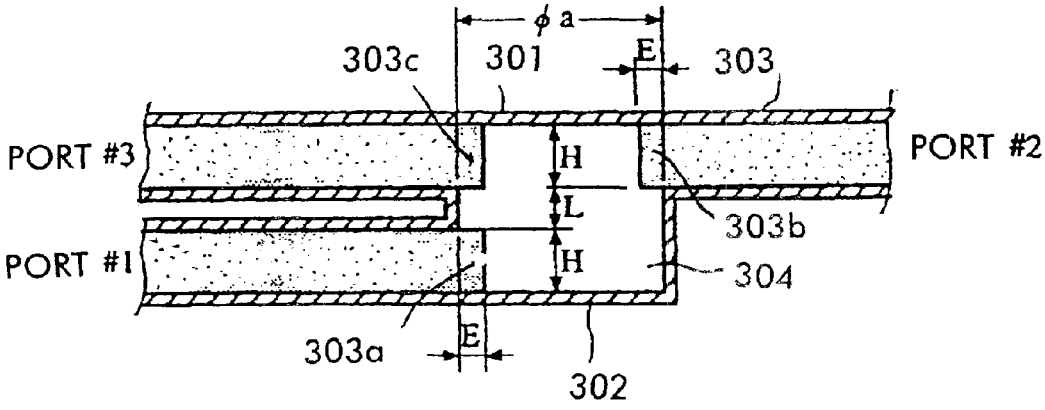
FIG. 9 shows a cross-sectional view of a construction of a connection part between a dielectric-waveguide and a waveguide, having three ports.

For example, the present embodiment may be applied to the high-frequency circuit with the double-layer structure where, as shown in FIG. 9, a dielectric strip 303*a* is a component of a first layer circuit board, and dielectric strips 303*b* and 303*c* are components of a second layer circuit board. Specifically, as shown FIG. 1 of Japanese Laid-open Patent Application No. 8-70,205 (U.S. Pat. No. 5,724,013), the line transition device of the present invention can be used in order to cause each "NRD circuit" in each layer to be mutually electromagnetically coupled in a high-frequency circuit where another "NRD circuit" is laminated on an "NRD circuit 3" shown in FIG. 1 of the above application.

Figure 8:
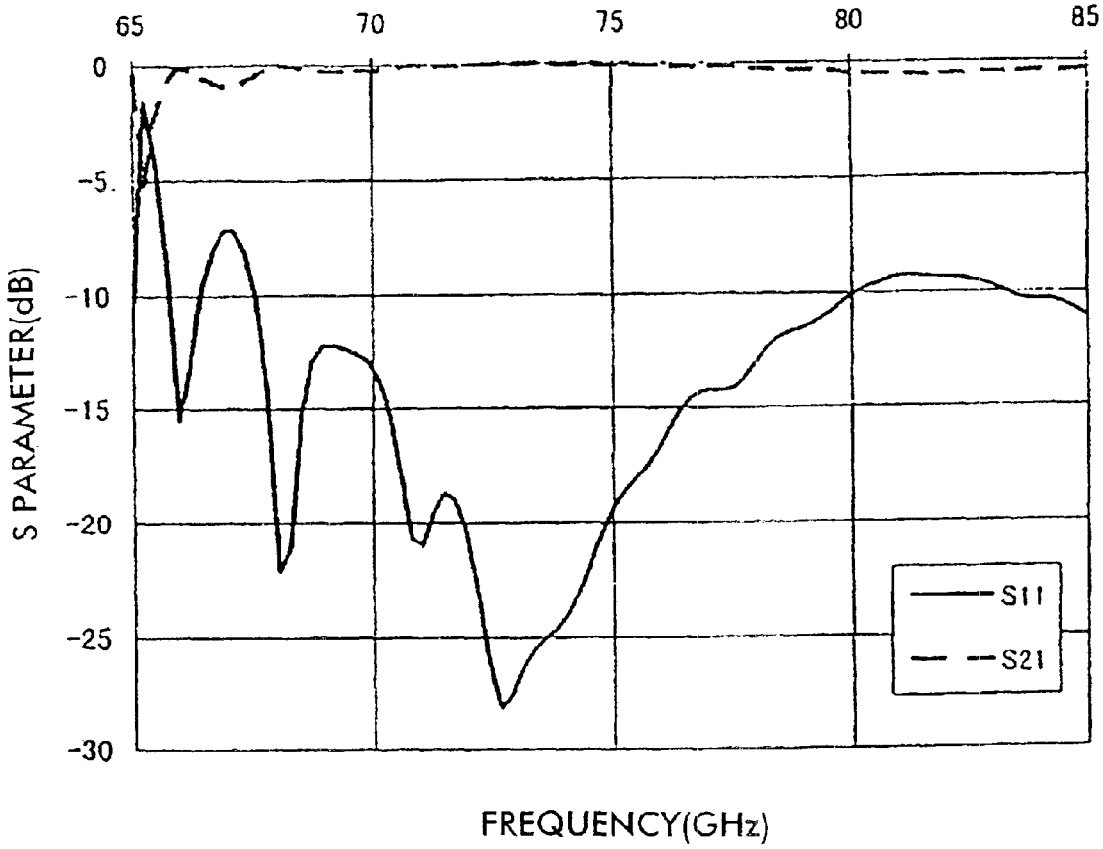
FIG. 8 shows characteristics of the construction of the connection part between the dielectric-waveguide and the waveguide in FIG. 7.

FIG. 8 shows reflection characteristics S11 as well as transmittance characteristics S21 (a signal is input from a port #2 and the output signal is observed at a port #1) between the two NRD guides in FIG. 7, where $\phi a$=2.8 mm, L=1.1 mm, H=1.8 mm, and E=0.4 mm and the above two NRD guides are used as input/output ports. In this example, low insertion loss characteristics are achieved over a broad band of 70 to 75 GHz and the reflection loss has a minimum value in the 73 GHz band. Accordingly, two NRD guides can be electromagnetically coupled under conditions of low reflection loss as well as low insertion loss at a predetermined frequency band.

Figure 10:
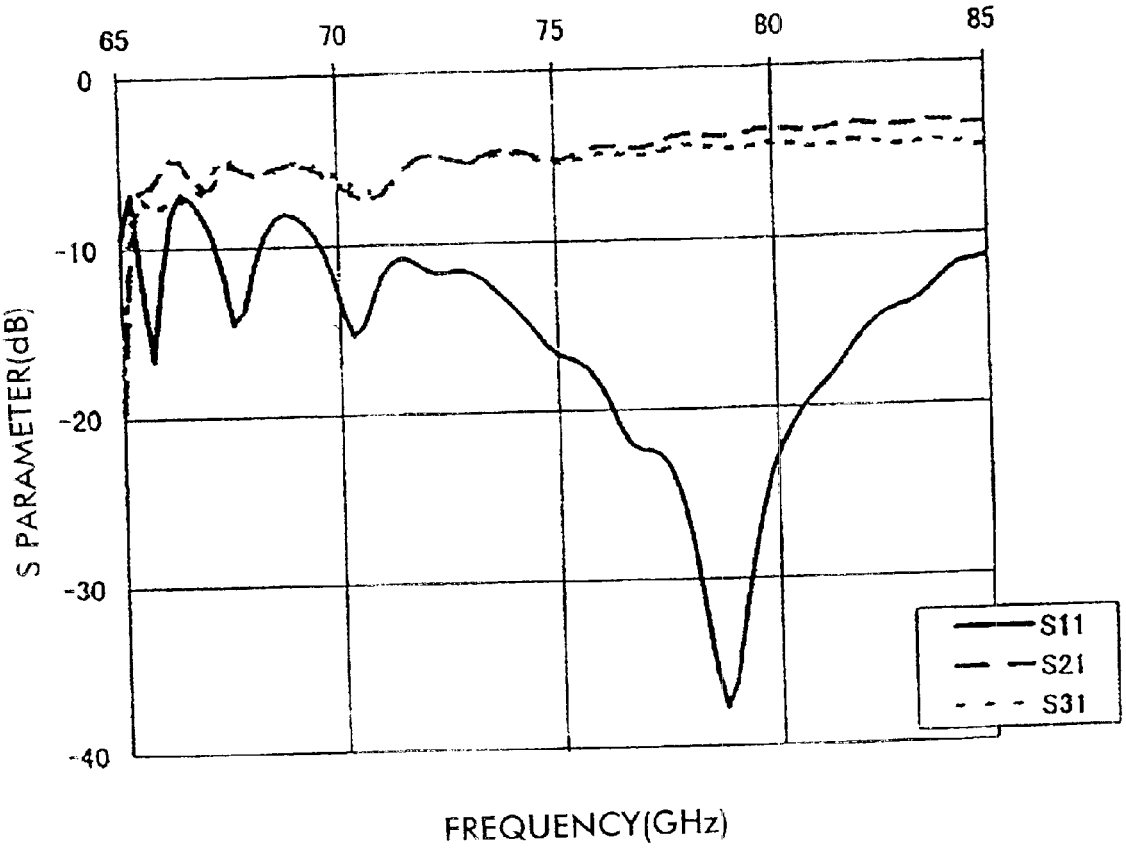
FIG. 10 shows characteristics of the construction of the connection part between the dielectric-waveguide and the waveguide in FIG. 9.

A construction of a connecting part of a dielectric waveguide according to a fifth embodiment of the present invention is described with reference to FIGS. 9 and 10.

The difference between the present embodiment and the fourth embodiment is that another NRD guide is connected to the waveguide 304. FIG. 10 shows characteristics S11, S21, and S31 where ϕa=2.8 mm, L=1.1 mm, H=1.8 mm, and E=0.4 mm in FIG. 9, and the three NRD guides are used as input/output ports. In this example, in the 78 GHz band, low reflection loss characteristics are obtained, observed at the port #1, and low insertion loss characteristics are obtained at ports #2 and #3. The line transition device of the present embodiment can also be applied to a high-frequency circuit having a two-layer structure.

Figure 11:
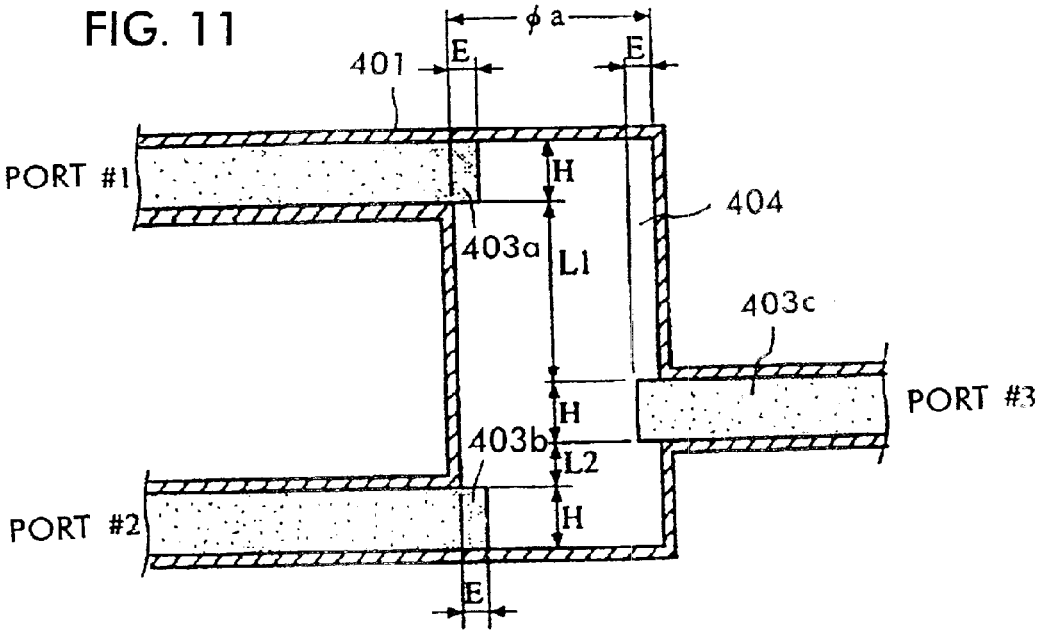
FIG. 11 shows a cross-sectional view of a construction of another connection part between a dielectric-waveguide and a waveguide, having three ports.
Figure 12:
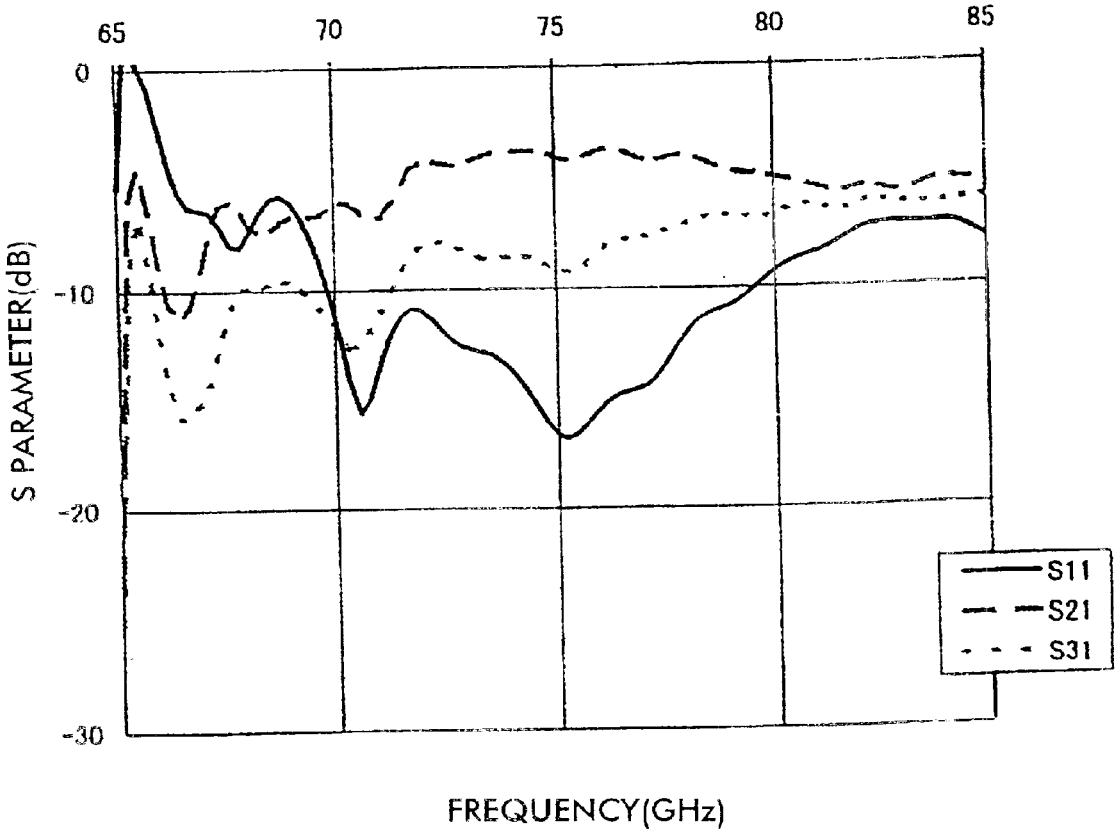
FIG. 12 shows characteristics of the construction of the connection part between the dielectric-waveguide and the waveguide in FIG. 12.

FIGS. 11 and 12 show a construction of a connecting part of a dielectric waveguide and characteristics thereof according to a sixth embodiment. The difference between the present embodiment and the fifth embodiment is that the position of each of three dielectric strips is different in the direction of the extension of the waveguide 404. FIG. 12 shows characteristics S11, S21, and S31 where ϕa=2.8 mm, L1=4.8 mm, L2=1.1 mm, H=1.8 mm, and E=0.4 mm in FIG. 1, and the three NRD guides are used as input/output ports. In this example, in the 75 GHz band, low reflection loss characteristics are obtained, observed at port #1, and the insertion loss from port #1 to port #2 is minimized. In practice, the insertion loss from the port #1 to the port #3 is acceptable. The line transition device of the present embodiment can be applied to a high-frequency circuit having a triple-layer structure.

Figure 13A:
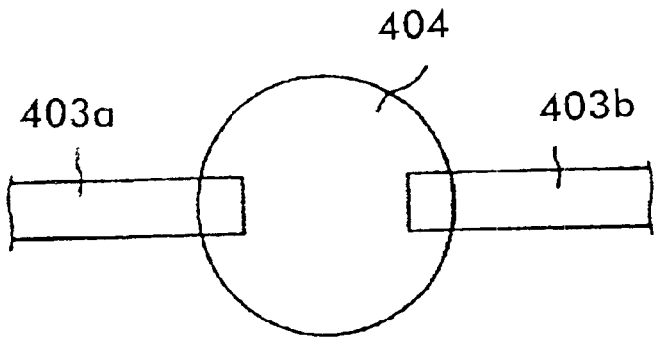
FIGS. 13A, 13B and 13C show plan views of the construction of the connection part between the dielectric-waveguide and the waveguide.
Figure 13B:
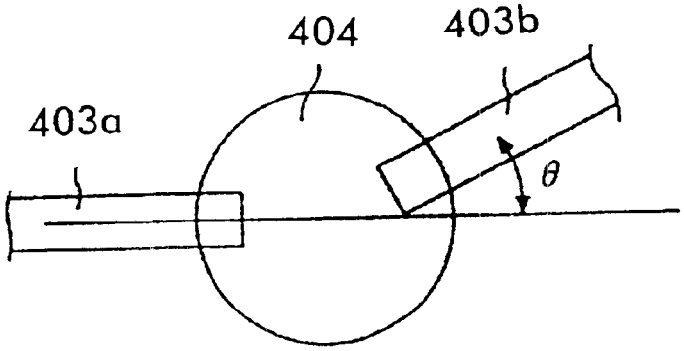
Figure 13C:
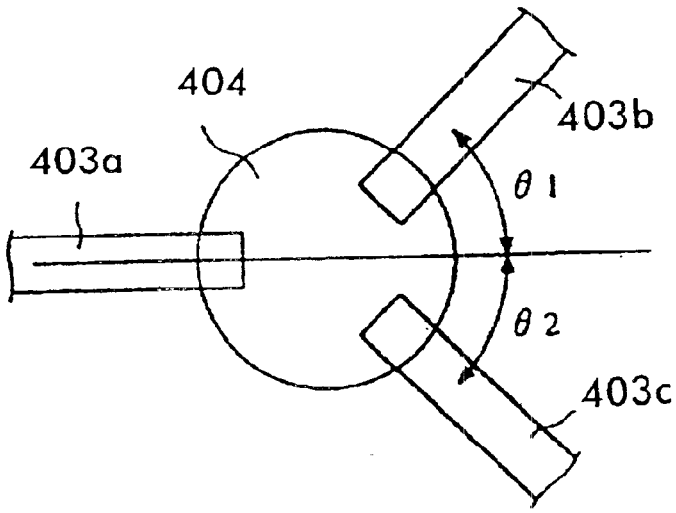

When multiple dielectric strips are inserted, as long as the direction of the extension of each dielectric strip 403 is substantially perpendicular to the propagating direction of the electromagnetic wave through the waveguide 404, the dielectric strip may be inserted from any direction in accordance with the intended use. For example, as shown in FIG. 13A, two dielectric strips 403*a* and 403*b* may be disposed so that the directions of the extension of each dielectric strip correspond to each other. As shown in FIG. 13B, two dielectric strips 403*a* and 403*b* may be disposed so that the direction of extension of the two dielectric strips forms an angle θ. As shown in FIG. 13C, three dielectric strips 403*a*, 403*b* and 403*c* are disposed so that the dielectric strips mutually have a predetermined angular relationship. In FIG. 13C, the waveguide 404 may employ a circular $TE_{01}$ mode, instead of a circular $TE_{11}$ mode. Since the circular $TE_{01}$ mode causes the electromagnetic distribution to be rotation-symmetric with respect to the center of the waveguide 404, signal transmission characteristics between dielectric strips do not change regardless of the angle formed by any two extensions of the dielectric strips.

Figure 14:
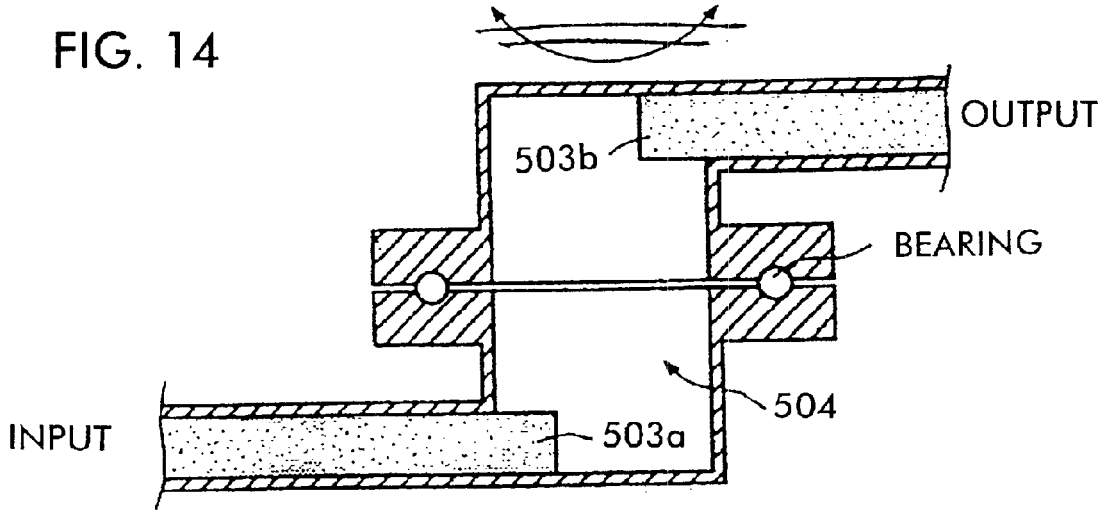
FIG. 14 shows a construction of a connection part between a dielectric-waveguide and a waveguide in which the angular relationship among input/outputs ports is changeable.

FIG. 14 shows a construction of a connecting part of a dielectric waveguide according to a seventh embodiment of the present invention. A columnar cavity waveguide 504 is divided into two portions, an upper portion and a lower portion. Bearings are provided as a rotary joint around the connection part of flanges surrounding the waveguide 504. Such a construction enables an intersecting angle between dielectric strips 503*a* and 503*b* to be freely changed. A polarizer (not shown) is provided inside the waveguide 504 and causes the plane of polarization of the electromagnetic wave to be rotated in accordance with the voltage applied thereto. By controlling the voltage applied to the polarizer in accordance with an intersecting angle θ, regardless of the angle θ, the two dielectric strips 503*a* and 503*b* in an $LSM_{01}$ mode and the waveguide 504 in a circular $TE_{11}$ mode remain electromagnetically coupled in an optimized manner. Therefore, low insertion loss characteristics can always be obtained.

Figure 15:
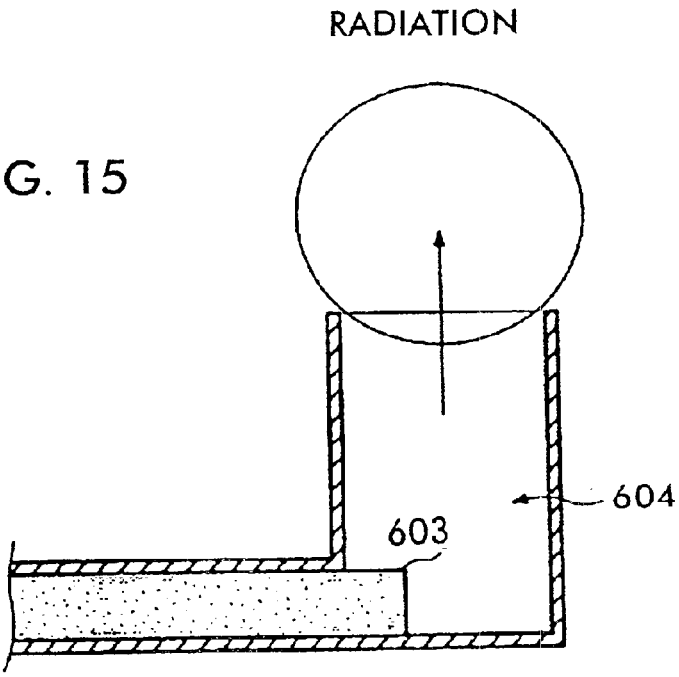
FIG. 15 is a cross-sectional view showing a construction of a primary radiator.
Figure 16:
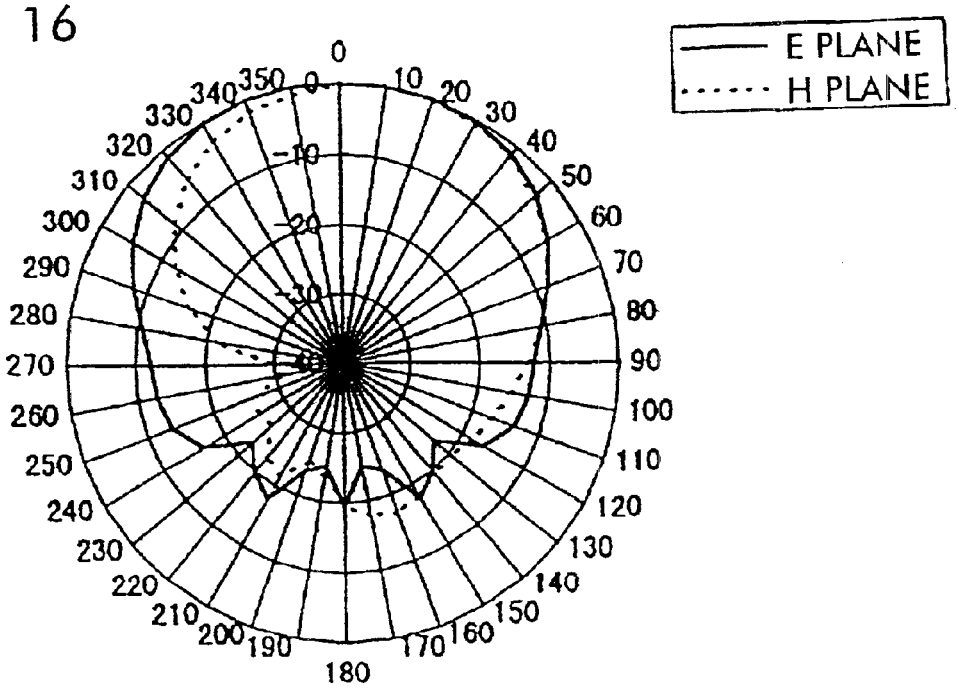
FIG. 16 illustrates a radiating pattern of the primary radiator in FIG. 15.

In the above embodiments, if no wall is provided at the upper or lower portion of a waveguide 604 (See FIG. 15), the waveguide 604 functions as a primary radiator of an antenna. For example, as shown in FIG. 15, when the top wall of the waveguide 604 is removed, an electromagnetic wave is propagated through the waveguide 604, then is radiated outside from the position where the top wall is removed. The waveguide 604 may also function as a horn antenna having an opening at the top face. The circle in the figure symbolically represents a radiation pattern. FIG. 16 shows measurement of radiation where a solid line represents an "E plane" and a broken line represents an "H plane". This construction having the opening at one face of the columnar cavity waveguide 604 allows a beam to be formed with a relatively broad half-power angle.

Figure 17:
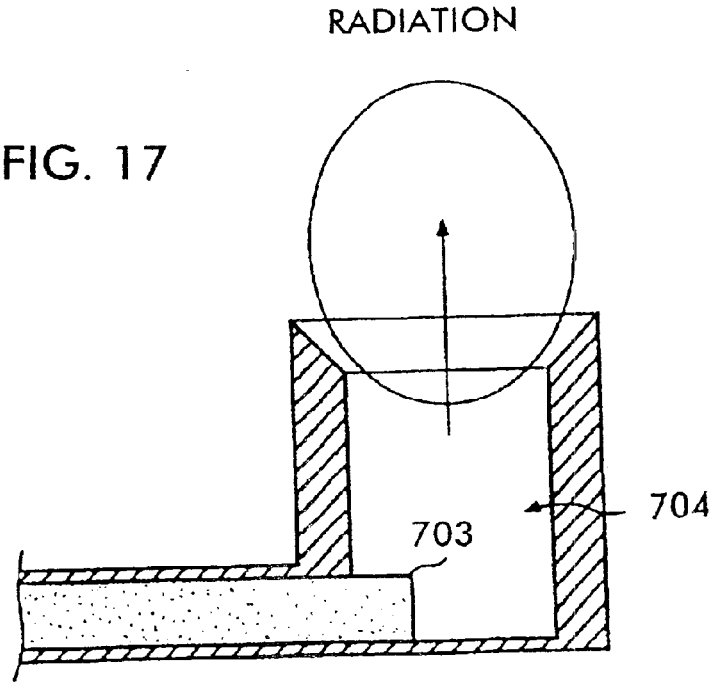
FIG. 17 is a cross-sectional view showing a construction of another primary radiator.

FIG. 17 shows a cross-sectional view showing a construction of another primary radiator. In this example, tapered sections are provided at the inner wall of a waveguide 704 in the proximity of the opening thereof. That is, the walls in the tapered sections become thinner toward the opening. This construction normally allows the distribution pattern to have long components in the direction of the axis, and in contrast, to have short components in the direction perpendicular to the axis. The radiating pattern can be controlled in accordance with the shape of the tapered sections, e.g. the rate of change in the direction of the wall thickness at the tapered sections. Thus, an antenna device with high gain and with a relatively narrower half-power angle is formed.

Figure 18:
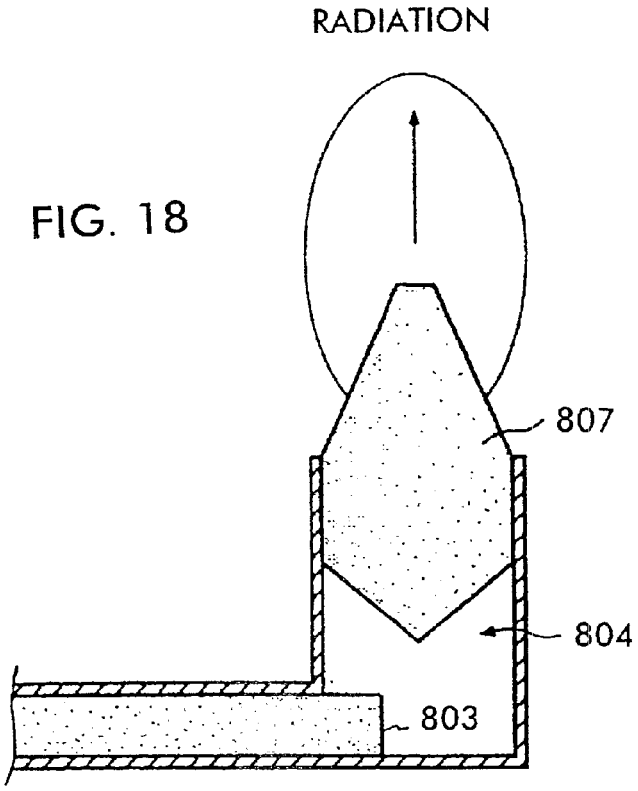
FIG. 18 is a cross-sectional view showing a construction of still another primary radiator.

FIG. 18 is a cross-sectional view showing a construction of still another primary radiator. In this example, a dielectric rod 807 is provided around the opening of the waveguide 804. According to this construction, the primary radiator functions as a dielectric-rod antenna whose radiating pattern depends on the length of the dielectric rod 807 and the taper shape of an edge thereof. This construction enables the radiator to have better directional characteristics than the one shown in FIG. 17.

The above examples show that small primary radiators can be constructed with simple structures. Unlike conventional primary radiators which radiate electromagnetic waves from a slot by electromagnetic-coupling to a dielectric resonator, the primary radiator of the present invention can provide a broad band characteristic.

Figure 19:
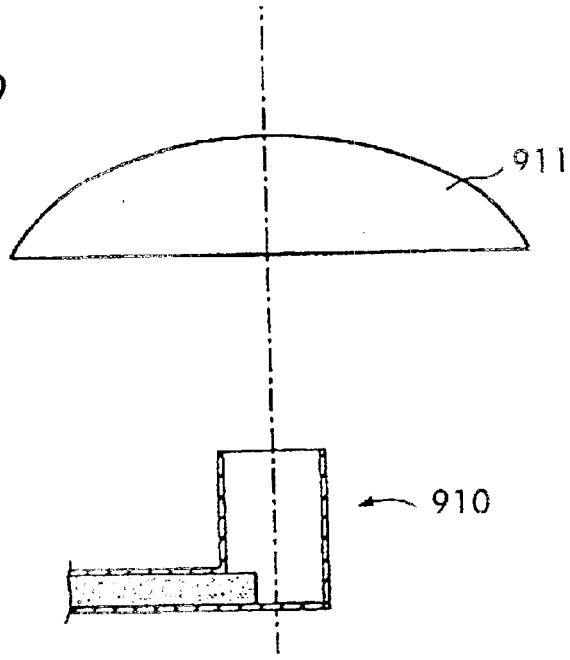
FIG. 19 is a cross-sectional view showing an antenna device employing a primary radiator and a dielectric lens.

FIG. 19 is a cross-sectional view showing a construction of an antenna device using the above-described various types of primary radiators. In FIG. 19, numeral 910 indicates a primary radiator, and numeral 911 indicates a dielectric lens. By providing the dielectric lens 911 at an appropriate location, the directional characteristics of the antenna are furthermore increased, which enables a high gain to be obtained.

Figure 20A:
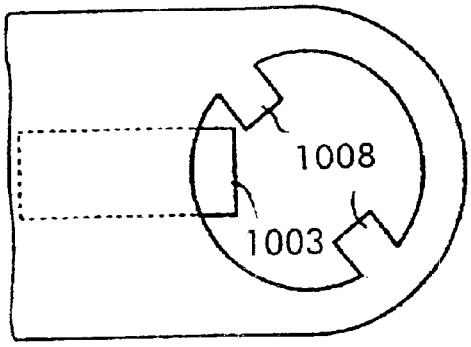
FIGS. 20A and 20B show a construction of a primary radiator having a polarization control device.
Figure 20B:
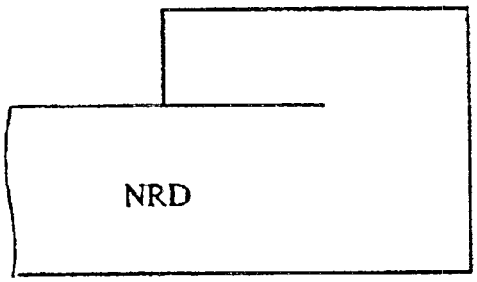

FIGS. 20A and 20B show a primary radiator which can perform polarization-control. The circular cavity waveguide and the NRD guide in FIGS. 20A and 20B have the same relationship as the ones shown in FIGS. 1, 2, and 15. In this example, inner portions of the waveguide project inward to form degenerate separation elements 1008, where the direction of the dielectric strip 1003 and the direction of the axis defined by the elements 1008 in the plan view intersect at an angle of approximately forty-five degrees. Since the projections destroy the symmetry inside the waveguide, two degenerate modes are destroyed, thereby establishing a phase difference between the electric field and the magnetic field. This allows a circularly polarized electromagnetic wave (including an elliptically polarized electromagnetic wave) to radiate. Accordingly, when a signal in the $LSM_{01}$ mode is transmitted from the NRD guide, the circularly polarized electromagnetic wave is radiated. When the circularly polarized electromagnetic wave is incident, the received signal is transmitted in the $LSM_{01}$ mode through the NRD guide due to the antenna reciprocity theorem.

Figure 21:
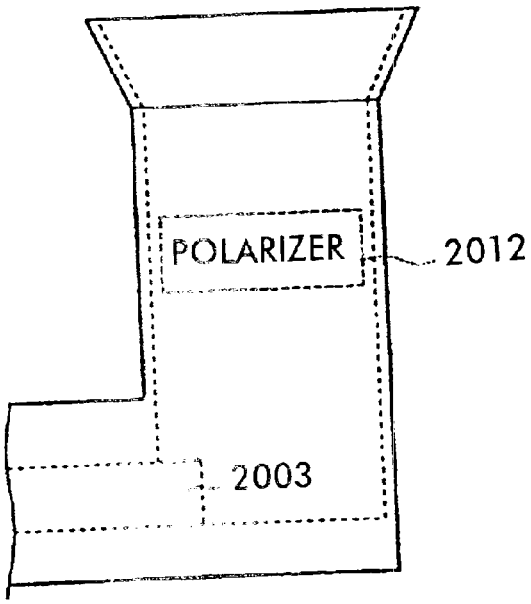
FIG. 21 shows a construction of another primary radiator having the polarization control device.

FIG. 21 shows a construction of another primary radiator which can perform polarization-control. In this example, the waveguide has a polarizer 2012 installed and a plane of polarization is rotated by a predetermined angle. The plane of polarization of the columnar cavity waveguide in the circular $TE_{11}$ mode, which is determined by the direction of a dielectric strip 2003, is rotated and radiated by the polarizer 2012. An incident wave is rotated by the polarizer 2012 and electromagnetically coupled with the NRD guide in the $LSM_{01}$ mode.

Figure 22A:
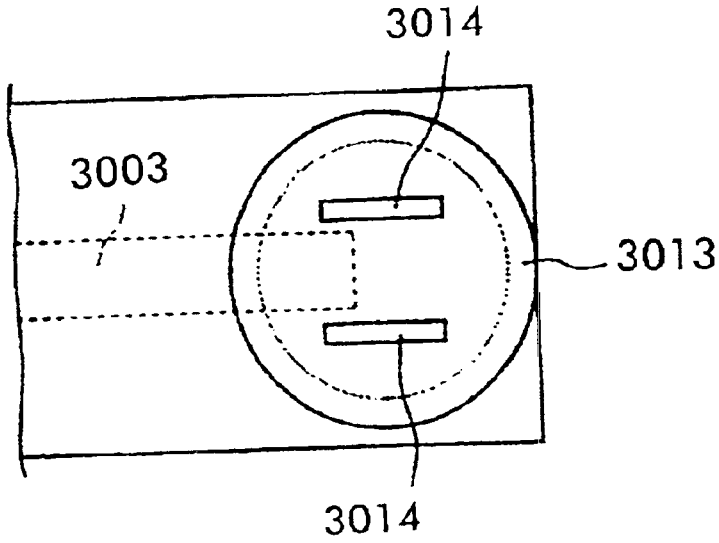
FIG. 22A (plan view) and FIG. 22B (cross sectional view) show a construction of still another primary radiator having the polarization control device.
Figure 22B:
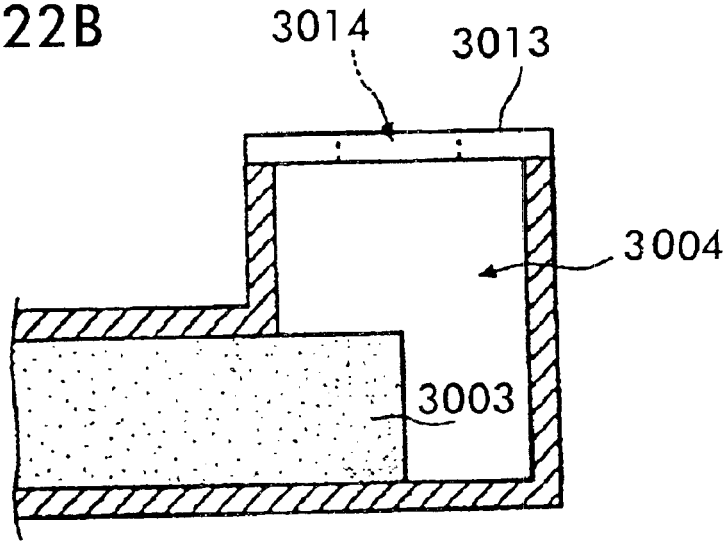

FIGS. 22A and 22B show a construction of still another primary radiator which can perform polarization-control. FIG. 22A is a plan view of a primary radiator, observed from a radiating face, and FIG. 22B is a cross-sectional view of the primary radiator. In this example, a slot plate 3013 is disposed at an opening of the waveguide, and has slots 3014 formed thereon. Because the slots 3014 radiate an electromagnetic wave in which the direction of the minor axis thereof is established as the direction of the electric field, the direction of the plane of polarization can be determined by determining the direction of the slot 3014.

Figure 23:
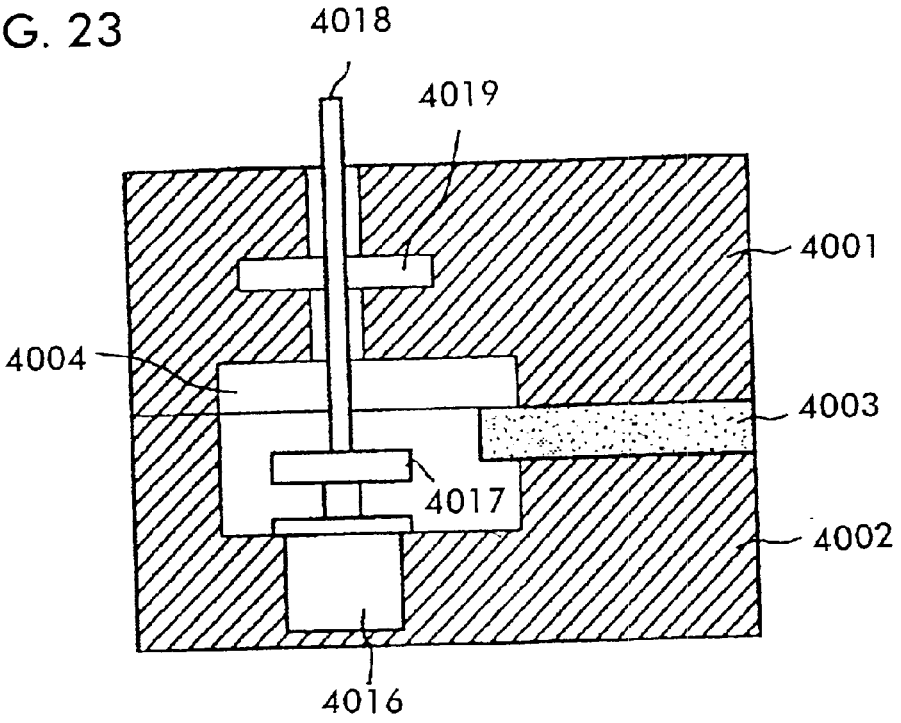
FIG. 23 is a cross-sectional view showing a construction of an oscillator.

FIG. 23 shows a construction of an oscillator using a transition device between a dielectric-waveguide and a waveguide. Numerals 4001 and 4002 indicate conductive plates, thereby constituting upper and lower parallel conductive faces of an NRD guide and a waveguide 4004. The waveguide 4004 used is a columnar cavity resonator. A waveguide strip 4003 is held between the parallel conductive faces thereby constituting the NRD. There is space at both sides of the dielectric strip 4003 which functions as a cutoff region. The conductive plate 4002 has a Gunn diode 4016 installed thereon, wherein one terminal of the Gunn diode 4016 is grounded to the conductive plate 4002, and the other terminal thereof projects upward. Numeral 4017 indicates a disk coupling conductor which is installed on the projecting terminal of the Gunn diode 4016. A bias-voltage supply-path 4018 for the diode 4016 is mounted to pass through a through-hole disposed in the conductive plate 4001. A dielectric material having a low dielectric constant is advantageously inserted between the element 4001 and the element 4018 above and below the element 4019. In the middle of the through-hole there is provided a cavity region which functions as a trap 4019 where the radius of the through-hole is an odd number multiple of a quarter of the guide wavelength.

With this construction, the oscillating output signal from the Gunn diode 4016 is conducted into the coupling conductor 4017, and the coupling conductor 4017 causes a resonance mode of a cavity resonator defined by the waveguide 4004 to be excited. The cavity resonator 4004 in the resonance mode and the NRD guide 4003 in the $LSM_{01}$ mode are electromagnetically coupled, and an oscillating signal is conducted.

Figure 24:
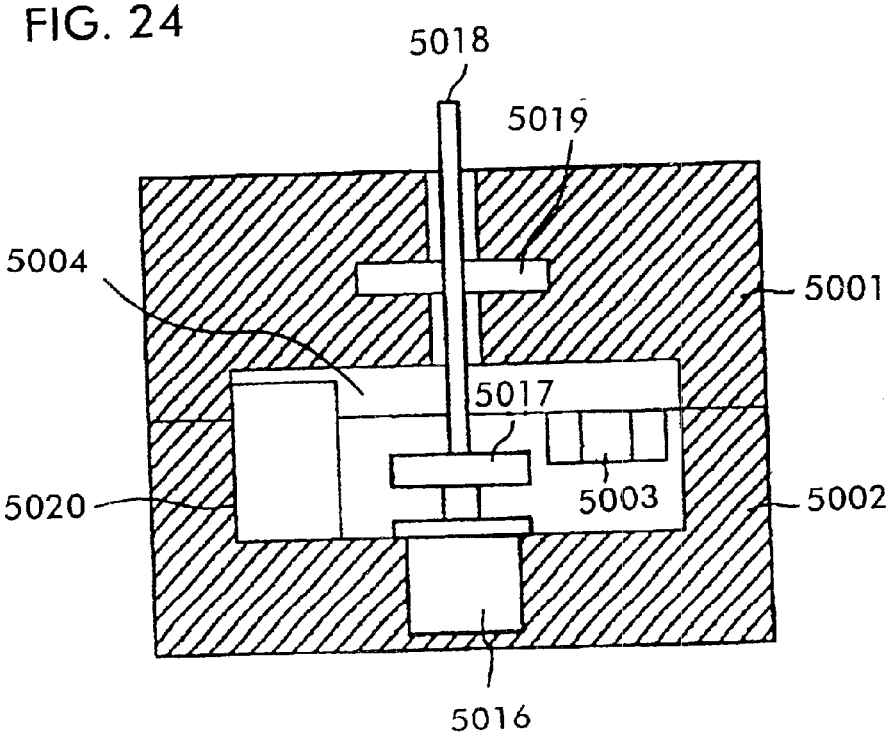
FIG. 24 is a cross-sectional view showing a construction of another oscillator.

FIG. 24 is a cross-sectional view showing a construction of another oscillator. Unlike the cross-sectional view in FIG. 23, this figure shows the cross-sectional view observed from the direction in which an end face of a dielectric strip 5003 can be seen. A waveguide 5004 forms a cavity resonator and has a temperature-compensation dielectric 5020 therein. Because the effective dielectric constant of the cavity resonator defined by the waveguide 5004 is determined by the dielectric constant of the dielectric 5020, the resonant frequency of the cavity resonance is varied in accordance with the change of the dielectric constant of the temperature compensation dielectric 5020. Therefore, dielectric-constant temperature-characteristics of the temperature compensation dielectric 5020 may be established so that temperature characteristics of the oscillating frequency of the Gunn diode 5016 are stabilized.

As set forth in co-pending U.S. patent application Ser. No. 09/430,650, filed Oct. 29, 1999, Attorney Docket P/1071-872, incorporated by reference, the change of the dielectric constant with the ambient temperature varies in accordance with the dielectric material. Any dielectric having suitable characteristics can be selected as required.

Figure 25A:
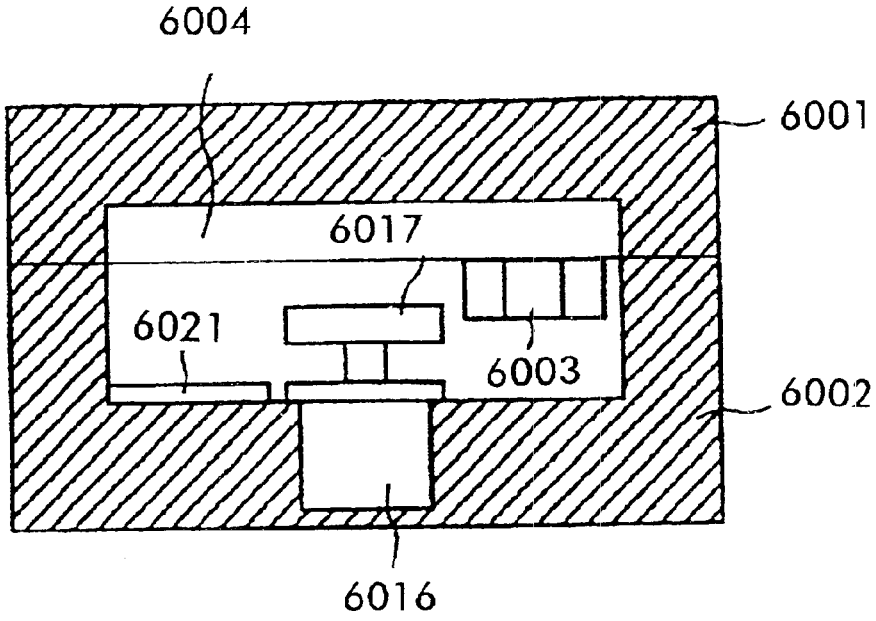
FIGS. 25A and 25B are a cross-sectional and a plan views, respectively, showing a construction of an oscillator.
Figure 25B:
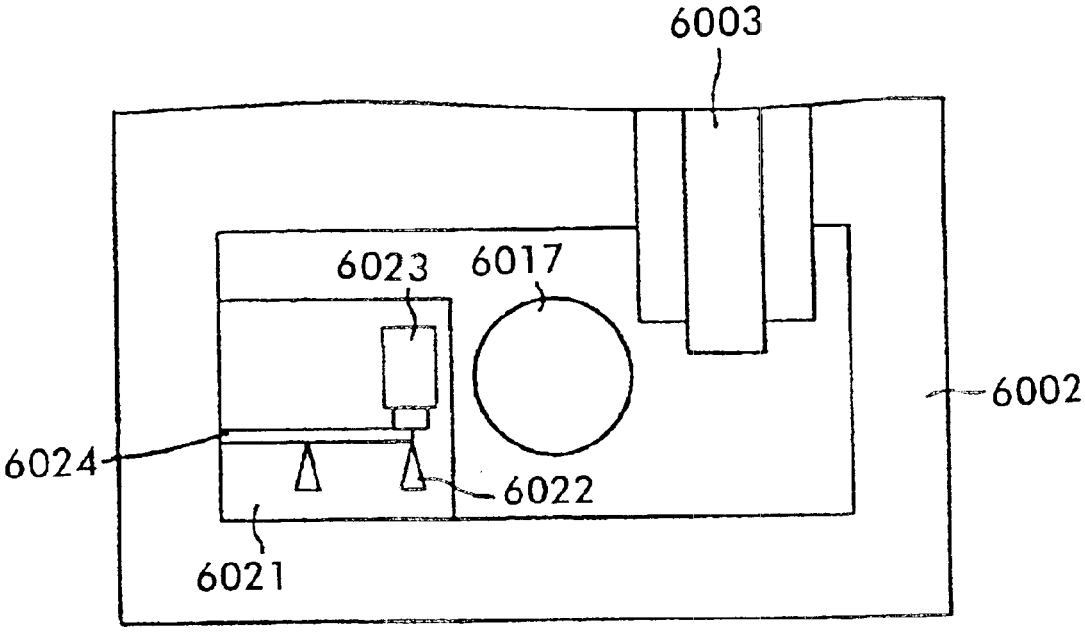

FIGS. 25A and 25B show a construction of still another oscillator, where FIGS. 25A and 25B show a cross-sectional view and a plan view, respectively, of the inside of a waveguide 6004. In this example, the waveguide 6004 has a circuit board 6021 therein. The circuit board 6021 has a variable reactance element 6022, an electrode 6023, and a control-voltage supply-path 6024 for supplying a control voltage to the variable reactance element 6022. A stub is provided in the middle of the control-voltage supply-path 6024 to prevent the oscillating signal from interfering with the control-voltage supply-path. Since the electrode 6023 is electromagnetically coupled with a coupling conductor 6017, the load of the Gunn diode 6016 includes the reactance component of the reactance element 6022. Therefore, the oscillating frequency of the Gunn diode 6016 is controlled in accordance with the control voltage applied to the variable reactance element 6022.

Figure 26:
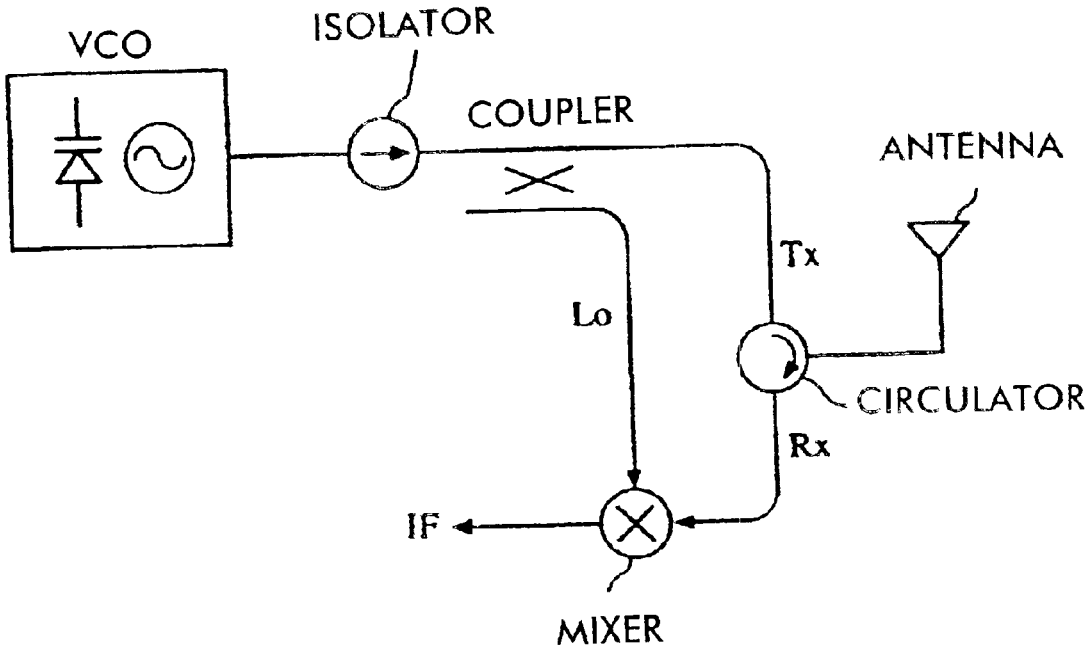
FIG. 26 is a block diagram showing a construction of a transmitting/receiving module.

FIG. 26 shows one example of a transmitting/receiving module which is used with a millimeter wave laser. In FIG. 26, a VCO is a variable oscillating-frequency oscillator. An antenna includes one of the above primary radiators and a dielectric lens. In FIG. 26, an output signal from the VCO is transmitted by way of an isolator, a coupler, and a circulator; on the other hand, a signal received at the antenna is input to a mixer through the circulator. The mixer mixes the received signal RX with a local signal Lo distributed by the coupler, thereby outputting the frequency difference between the sending signal and the received signal as an intermediate frequency signal IF. A control circuit (not shown) modulates an oscillating signal from the VCO and finds the frequency difference between the IF signal and a target signal, and a relative velocity.

In each embodiment, the waveguide is constructed as a cavity waveguide. However, the waveguide may also be filled with a dielectric instead.

In each embodiment, the location where the dielectric strip is inserted into the waveguide is not particularly specified. For example, the dielectric strip 3 may be inserted at a position higher in the waveguide 4 than the position shown in FIG. 1.

Although the present invention has been described in relation to particular embodiments thereof, many other variations and modifications and other uses will become apparent to those skilled in the art. Therefore, the present invention is not limited by the specific disclosure herein.

What is claimed is:

1. A line transition device disposed between a dielectric waveguide having a dielectric strip disposed between a pair of conductors which face each other, and a waveguide, wherein a part of said dielectric strip of said dielectric waveguide is adjacent to said waveguide, and wherein said dielectric strip is disposed substantially perpendicular to the propagating direction of an electromagnetic wave through the waveguide.

2. A line transition device disposed between a dielectric waveguide having a dielectric strip disposed between a pair of conductors which face each other, and a waveguide, wherein a part of said dielectric strip of said dielectric waveguide is adjacent to said waveguide, and wherein said waveguide and said dielectric waveguide are matched by a locally changing cross-sectional shape of a side wall of said waveguide.

3. A line transition device between a plurality of dielectric waveguides, each dielectric waveguide having a respective dielectric strip disposed between a pair of conductors which face each other, and a waveguide, wherein a part of said respective dielectric strip of each said dielectric waveguide is adjacent to said waveguide.

4. A line transition device, according to claim 3, wherein said part of said dielectric strip of each said dielectric waveguide is inserted into said waveguide.

* * * * *